US010734182B2

(12) United States Patent
Sessions et al.

(10) Patent No.: US 10,734,182 B2
(45) Date of Patent: Aug. 4, 2020

(54) ULTRA-HIGH EFFICIENCY SINGLE-BEAM AND MULTI-BEAM INDUCTIVE OUTPUT TUBES

(71) Applicant: Georgia Tech Research Corporation, Atlanta, GA (US)

(72) Inventors: Walter Sessions, Marietta, GA (US); Henry P. Freund, Vienna, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 16/592,116

(22) Filed: Oct. 3, 2019

(65) Prior Publication Data

US 2020/0111636 A1 Apr. 9, 2020

Related U.S. Application Data

(60) Provisional application No. 62/740,488, filed on Oct. 3, 2018.

(51) Int. Cl.

| | |
|---|---|
| ***H01J 23/34*** | (2006.01) |
| ***H01J 25/04*** | (2006.01) |
| ***H01P 5/16*** | (2006.01) |

(52) U.S. Cl.

CPC ..... *H01J 23/34* (2013.01); *H01J 25/04* (2013.01); *H01P 5/16* (2013.01)

(58) Field of Classification Search

CPC ..... H01J 37/32091; H01J 37/32183; H01J 37/32577; H01J 23/34; H01J 25/04; H01P 5/16

USPC ..... 118/723 E, 723 R; 156/345.44; 427/578

See application file for complete search history.

(56) References Cited

U.S. PATENT DOCUMENTS 5,650,751 A 7/1997 Symons
2019/0379098 A1* 12/2019 Kinsey ..... H01P 3/12

OTHER PUBLICATIONS

De Villiers: "Analysis and Design of Conical Transmission Line Power Combiners"; Dec. 2007; University of Stellenboach.
CPI: "VKL-9130 IOT Amplifier"; believed to have been published before Oct. 3, 2018.
Zolfghari et al.: "Comparison of Klystron and Inductive Output Tubes (IOT) Vacuum-Electron Devices for RF Amplifier Service in Free-Electron Laser"; dated Apr. 23, 2011; Aneka Info Teknik.

* cited by examiner

*Primary Examiner* — Wei (Victor) Y Chan
(74) *Attorney, Agent, or Firm* — Bryan W. Bockhop; Bockhop Intellectual Property Law, LLC

(57) ABSTRACT

A radio frequency (RF) modulating signal splitter used by a multi-beam electron beam RF amplification system includes an RF input port and a plurality of RF output ports. A body frame distributes the RF modulating signal from the input port to the of output ports. The body frame and each one of the RF output ports have dimensions so that each one of the plurality of RF output ports is impedance matched with each other. In a method of modulating a RF input signal onto a plurality of electron beams, the RF input signal is split into a plurality of different paths directed to a plurality of output ports that are impedance matched to each other. RF energy is directed from each output port to a different input cavity of electronic beam RF amplification devices of a multi-beam electronic beam RF amplification system.

14 Claims, 3 Drawing Sheets

ULTRA-HIGH EFFICIENCY SINGLE-BEAM AND MULTI-BEAM INDUCTIVE OUTPUT TUBES

CROSS-REFERENCE TO RELATED APPLICATION(S)

This application claims the benefit of U.S. Provisional Patent Application Ser. No. 62/740,488, filed Oct. 3, 2018, the entirety of which is hereby incorporated herein by reference.

BACKGROUND OF THE INVENTION

1. Field of the Invention

The present invention relates to radio frequency (RF) signal amplification systems and, more specifically, to a system for distributing an RF signal to a plurality of RF signal amplifying units.

2. Description of the Related Art

Radio frequency (RF) amplification systems for high gain applications (such as satellite communications systems and particle beam accelerators) often amplify relatively low power RF modulating signals up to an output power range from the tens of kilowatts (kW) to hundreds of kW. Such systems usually employ electron beam amplification devices, such as klystrons and inductive output tubes. While configured differently, these devices modulate an input RF signal onto a high power electron beam and then harvest RF energy from the electrons in the electron beam.

Currently, requirements for bandwidth, high power, and reasonable efficiency in RF and millimeter-wave (mw) generating devices have come from both the military and industrial communities. These three parameters have driven the majority of research in both the vacuum-tube and solid-state industries. Of significant interest is the area of multi-beam (MB) electron guns for vacuum electronics. Most research in MB technology has focused in narrow-band solutions, as many of the applications are directed to accelerators and radar systems. The advent of military interests in wideband technology, has led to a few efforts to extend the research towards MB devices that could achieve 15%-20% bandwidth.

An inductive output tube (IOT) is a hybrid device consisting of a triode gun (RF) with Klystron output circuit and is sometimes commercially referred to as a "Klystrode®." The basic working of an IOT is relativity simple. As shown in FIG. 1, one type of prior art IOT 10 includes a cathode 12, which is typically heated to encourage thermoelectric emission of electrons toward an anode 18. The resulting electron beam is shaped by a focus electrode 16 and accelerated through a drift tube 20 past a gap 21 through tail pipe 22 into an electron collector 24. A control grid 14 is used to add the RF signal to the electrons in the beam, causing them to become more dense and less dense according to the swing of the RF signal. As the electrons pass through the gap 21, they give off their kinetic RF energy in a cavity portion 23 as an amplified RF signal and then the spent electrons are absorbed by the collector 24.

IOTs tend to be smaller and less expensive than klystrons. However, they also generate an output with a gain that is much lower than that produced by klystrons. One possible solution to this problem would be to employ several IOTs in parallel in which the amplified RF signals from each of the IOTs are fed into a common cavity for use in the desired application. Unfortunately, most research in multi-beam (MB) IOTs has resulted in damage to the IOTs due to impedance mismatching and other issues.

Therefore, there is a need for a stable multi-beam IOT system.

SUMMARY OF THE INVENTION

The disadvantages of the prior art are overcome by the present invention which, in one aspect, is a device for splitting a radio frequency (RF) modulating signal for use by a multi-beam electron beam RF amplification system that includes an RF input port and a plurality of RF output ports. A body frame is receives the RF modulating signal from the RF input port and distributes the RF modulating signal to each of the plurality of RF output ports. The body frame and each one of the plurality of RF output ports have dimensions so that each one of the plurality of RF output ports is impedance matched with each other one of the plurality of RF output ports.

In another aspect, the invention is a multi-beam system for amplifying a radio frequency (RF) modulating signal that includes an RF beam splitting device. The RF beam splitting device includes an RF input port configured to receive the RF modulating signal and a plurality of RF output ports configured to transport the RF modulating signal. A body frame distributes the RF modulating signal to each of the plurality of RF output ports. The body frame and each one of the plurality of RF output ports have dimensions so that each one of the plurality of RF output ports is impedance matched with each other one of the plurality of RF output ports. A plurality of electron beam RF amplification devices each include: an input cavity that is configured to receive the RF modulating signal from a different one of the plurality of RF output ports and each is configured to modulate the RF modulating signal onto a different electron beam. An output cavity receives amplified RF energy from the electron beams.

In yet another aspect, the invention is a method of modulating a radio frequency (RF) input signal onto a plurality of electron beams, in which the RF input signal is transported into a cavity. The RF input signal is split into a plurality of different paths corresponding to a plurality of output ports that are coupled to the cavity and that are impedance matched to each other. RF energy is directed from each of the output ports to a different input cavity of a plurality of electronic beam RF amplification devices that are part of a multi-beam electronic beam RF amplification system.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
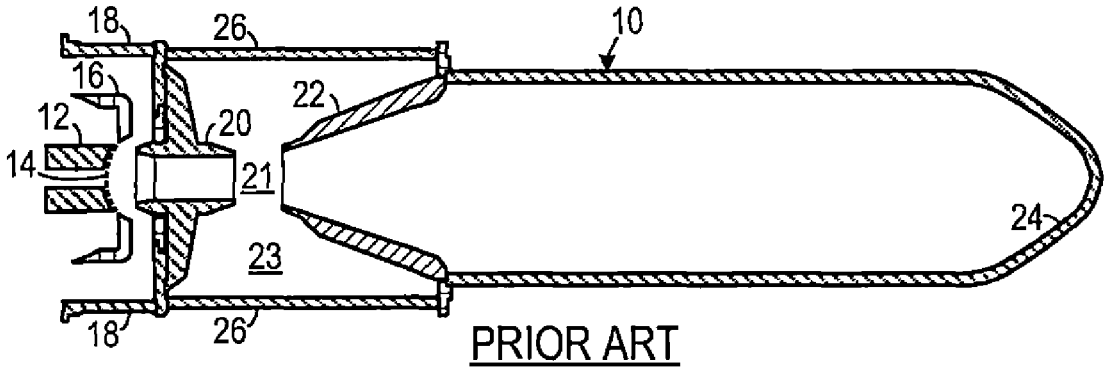
PRIOR ART FIG. 1
FIG. 1 is a schematic diagram of one type of prior art inductive output tube.
Figure 2A:
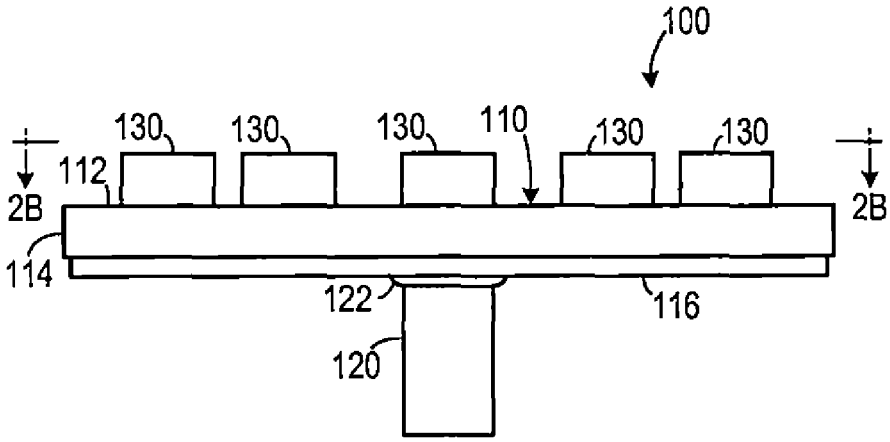
FIGS. 2A-2D are schematic diagrams of one representative embodiment of a device for distributing an RF input signal to a plurality of RF outputs.
Figure 2B:
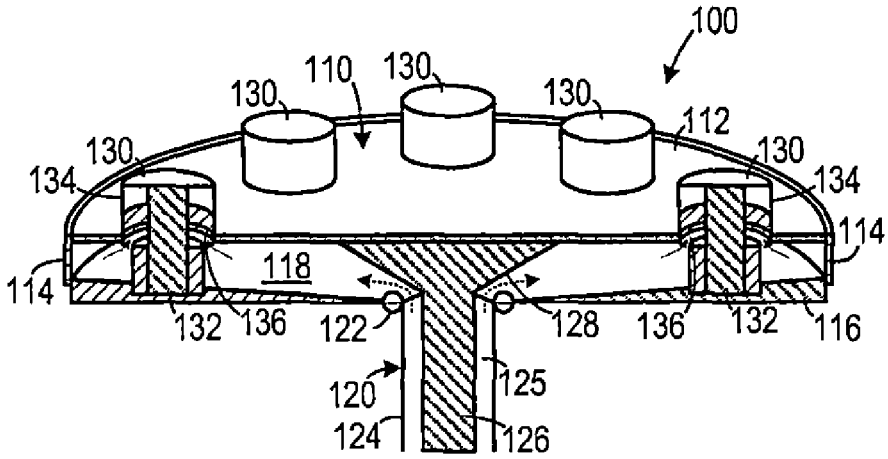
Figure 2C:
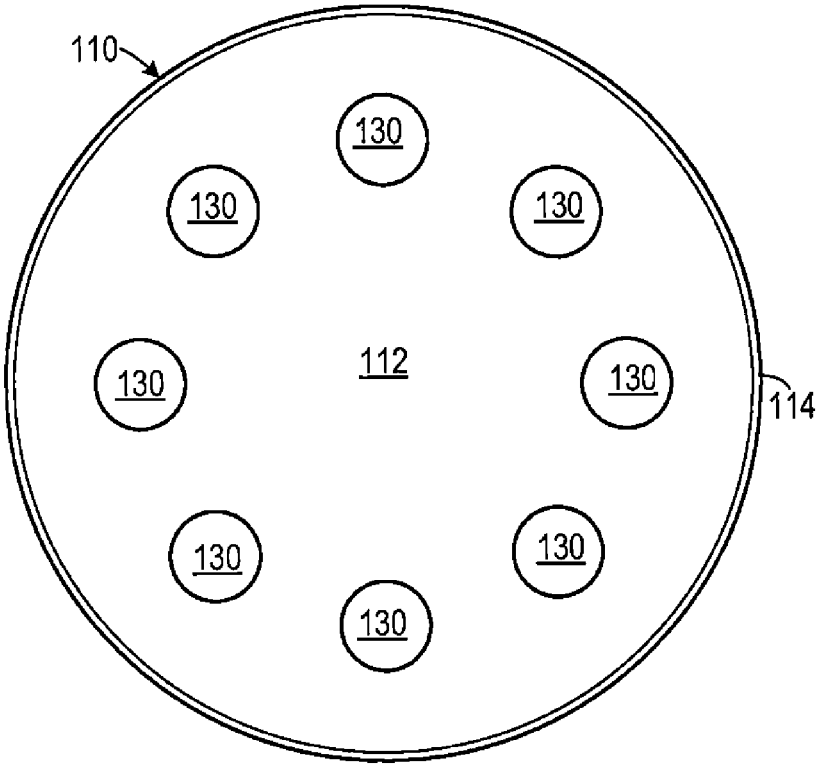
Figure 2D:
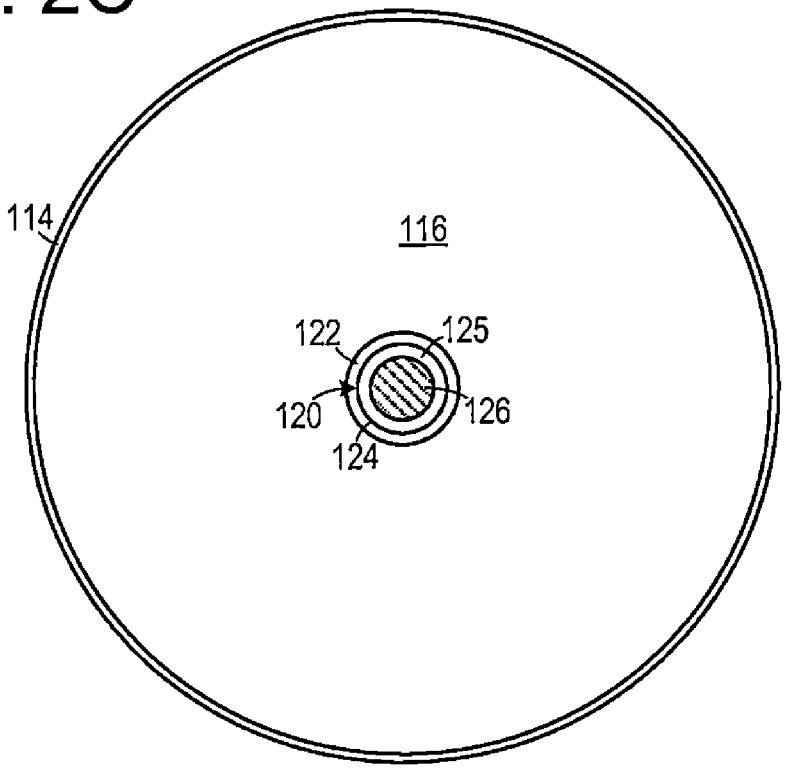

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 2A-2D, one representative embodiment of a radio frequency (RF) modulating signal splitting device 100 includes a coaxial RF input port 120 that feeds into a body frame 110 and a plurality of coaxial RF output ports 130 that are fed from the body frame 110. (It should be noted that, while eight output ports 130 are shown in the present example, configurations with different numbers of output ports 130 are well within the scope of the invention.) The input port 120 is a rigid coaxial conductor that includes an internal conductive member 126 a gap 126 and an external conductive shield member 124 that is coaxial with the internal conductive member 126. Similarly, the output ports 130 each include a central conductor member 132 an external shield member 134 and a gap there between 136. The body frame 110 includes a first disk-shaped conductive member 112 through which each of the plurality of RF output ports 130 extend. The RF output ports 130 are evenly spaced apart about a circle that is concentric with the center of conductive member 112. A peripheral conductive ring 114 is disposed about and depends downwardly from the periphery of the disk-shaped conductive member 112.

A second disk-shaped conductive member 116 has a center through which the RF input port 120 extends and is coupled to the peripheral conductive ring 114. The first conductive disk-shaped member 112, the second disk-shaped conductive member 116 and the peripheral conductive ring 114 define a cavity 118. The second conductive disk-shaped member 116 tapers inwardly toward the first conductive disk-shaped member 112 as it extends outwardly from the center to the peripheral conductive ring 114. The cavity 118 and the gaps 125 and 136 can be filled with a pressurized non-conductive gas, such as (for example, $N_2$, $SF_6$, dry air, or combinations thereof). The tapering is designed to ensure transverse electromagnetic (TEM) transport of the RF modulating signal to the plurality of RF output ports 130 so that the output ports 130 are impedance matched.

A trapezoidal yoke 128 extends from the center of the first disk-shaped conductive member 112 and tapers inwardly toward the RF input port 120. The trapezoidal yoke 128 is electrically coupled to the central conductor 126 of the input port 120. A toroidal yoke 122 couples the external conductive shield 124 to the second disk-shaped conductive member 116. Typically, all of these components can be made of a conductor, such as copper. The body frame 110 and each one of the plurality of RF output ports 130 have dimensions so that each one of the plurality of RF output ports 130 is impedance matched with each other one of the plurality of RF output ports 130, thereby maximizing the power output of the device.

The body frame 110 receives the RF modulating signal from the RF input port 120 distributes it to each of the plurality of RF output ports 130. In one embodiment, a circuit can add a third harmonic of the RF modulating signal to the RF modulating signal. This results in a closer approximation of a square wave output.

Figure 3:
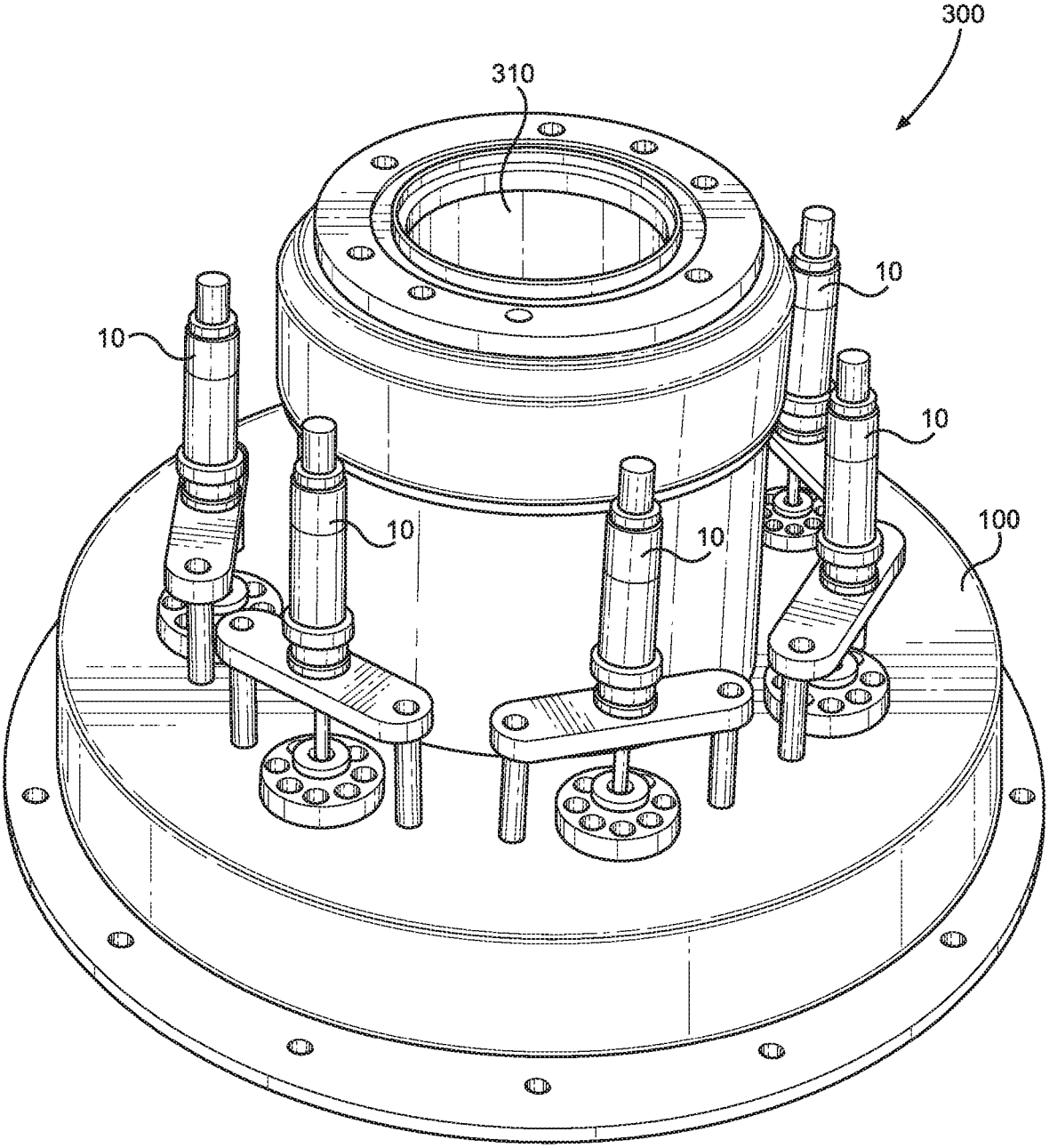
FIG. 3 is a photograph of a multi-beam IOT system employing an RF input distributing device of the type shown in FIGS. 2A-2D.

As shown in FIG. 3, a multi-beam system 300 for amplifying a radio frequency (RF) modulating signal can include an RF beam splitting device 100 as disclosed above with a plurality of electron beam RF amplification devices 10 (such as an inductive output tube of the type disclosed with reference to FIG. 1) in which the input cavity of each is coupled to the output port 130 of the RF beam splitting device 100. Each of the RF amplification devices 10 feeds a common output cavity 310 and is configured to receive amplified RF energy from the electron beams. In this embodiment, the RF input signal is split into N-paths; each path is directed to an individual RF amplification device, (each of which includes an isolated input cavity.) The RF signal is amplified down the N-beam tunnels. Then each beam exits its tunnel into a common output cavity 310, which transduces the summed amplified RF into an output coupler, via capacitive or inductive impedance matching through a ceramic window to either a coaxial or waveguide output line.

This device achieves a symmetrical fed about a given cathode-grid region of a multi-beam RF gun (e.g., an IOT). This RF-gun design is rooted in combining/dividing technology developed by the solid-state industry for high-power combining of HEMTs. One embodiment employs multiple RF guns in the UHF region, or any region of frequency in which the IOT operates. For the RF gun, at required MB-IOT power levels, input circuits will need to handle about 10-15 kW of CW-RF drive. This may be achieved by using the design of an N-way radial tapered line matching sections with TEM mode propagation from the coaxial feed to the individual ports (coaxial feds for each electron gun). The low impedance feed is achieved by linear or step tapers from the 50 ohm coax to the feed point. This can be optimized for minimum reflection across the band of interest. The feed region is designed via optimal taper to guarantee TEM mode transport, along with no high field regions for breakdown mitigation. Of note is that low impedance requires the conductor being close together. It has been found that even with a 10 ohm feed impedance, this approach should allow for tens of kilowatts of power dividing in the narrow neck region of the device. If higher powers are needed, one can use a pressurized ($N_2$ or $SF_6$) input circuit (from start of coax taper up through individual fed points) to gain margin needed to prevent breakdown.

It should be noted that each port that leads to an individual RF gun is then symmetrically fed coaxial path. This design allows for one to place tuners (broadband) on each gun drive line. DC blockers can then be placed on each gun-line (across the coax) which further reduces the risk by eliminating large mechanical DC blockers on the main/combined coaxial feed line. The drive ports can then the designed to optimally impedance match the RF-gun (cathode-grid gap) directly. This can result in fine tuning the device for maximum bandwidth, gain and efficiency as necessitated by the application.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A device for splitting a radio frequency (RF) modulating signal for use by a multi-beam electron beam RF amplification system, comprising: (a) an RF input port; (b) a plurality of RF output ports; and (c) a body frame configured to receive the RF modulating signal from the RF input port and to distribute the RF modulating signal to each of the plurality of RF output ports, wherein the body frame and each one of the plurality of RF output ports have dimensions so that each one of the plurality of RF output ports is impedance matched with each other one of the plurality of RE output ports; and wherein the body frame comprises: (a) a first disk-shaped conductive member, having a center, through which each of the plurality of RF output ports extend, the plurality of RF output ports being evenly spaced apart about a circle that is concentric with the center; (b) a peripheral conductive ring disposed about and depending downwardly from the first disk-shaped conductive member; (c) a second disk-shaped conductive member having a center through which the RF input port extends, the second disk-shaped conductive member coupled to the peripheral conductive ring so that the first conductive disk-shaped member, the second disk-shaped conductive member and the peripheral conductive ring define a cavity therein, wherein the second conductive disk-shaped member tapers inwardly toward the first conductive disk-shaped member as extends outwardly from the center to the peripheral conductive ring, the RF input port including a central conductor and a coaxial external conductive shield; (d) a trapezoidal yoke extending from the center of the first disk-shaped conductive member and tapering inwardly toward the RF input port, the trapezoidal yoke electrically coupled to the central conductor; and (e) a toroidal yoke that couples the external conductive shield to the second disk-shaped conductive member.

2. The device of claim 1, wherein the RF input port comprises a coaxial conductor.

3. The device of claim 1, wherein each of the RF output ports comprises a coaxial conductor.

4. The device of claim 1, wherein the cavity is tapered to ensure transverse electromagnetic (TEM) transport of the RF modulating signal to the plurality of RF output ports.

5. The device of claim 1, wherein the cavity is filled with a pressurized non-conductive gas.

6. The device of claim 5, wherein the pressurized non-conductive gas comprises a gas selected from a list consisting of: $N_2$, $SF_6$, dry air and combinations thereof.

7. The device of claim 1, wherein each of the plurality of RF output ports is coupled to an input cavity of a different inductive output tube that is part of a multi-beam inductive output tube system.

8. A multi-beam system for amplifying a radio frequency (RF) modulating signal, comprising: (a) an RF beam splitting device including: an RF input port configured to receive the RF modulating signal, a plurality of RF output ports configured to transport the RF modulating signal and a body frame configured to distribute the RF modulating signal to each of the plurality of RF output ports, the body frame and each one of the plurality of RF output ports having dimensions so that each one of the plurality of RF output ports is impedance matched with each other one of the plurality of RF output ports; (b) a plurality of electron beam RF amplification devices, each including: an input cavity that is configured to receive the RF modulating signal from a different one of the plurality of RF output ports and each configured to modulate the RF modulating signal onto a different electron beam; and (c) an output cavity to is configured to receive amplified RF energy from the electron beams; and wherein the body frame comprises: (a) a first disk-shaped conductive member, having a center, through which each of the plurality of RF output ports extend, the plurality of RF output ports being evenly spaced apart about a circle that is concentric with the center; (b) a peripheral conductive ring disposed about and depending downwardly from the first disk-shaped conductive member; (c) a second disk-shaped conductive member having a center through which the RF input port extends, the second disk-shaped conductive member coupled to the peripheral conductive ring so that the first conductive disk-shaped member, the second disk-shaped conductive member and the peripheral conductive ring define a cavity therein, wherein the second conductive disk-shaped member tapers inwardly toward the first conductive disk-shaped member as it extends outwardly from the center to the peripheral conductive ring, the RF input port including a central conductor and a coaxial external conductive shield; (d) a trapezoidal yoke extending from the center of the first disk-shaped conductive member and tapering inwardly toward the RF input port, the trapezoidal yoke electrically coupled to the central conductor; and (e) a toroidal yoke that couples the external conductive shield to the second disk-shaped conductive member.

9. The system of claim 8, wherein the RF input port comprises a coaxial conductor.

10. The system of claim 8, wherein each of the RF output ports comprises a coaxial conductor.

11. The multi-beam system of claim 8, wherein the cavity is tapered to ensure transverse electromagnetic (TEM) transport of the RF modulating signal to the plurality of RF output ports.

12. The multi-bears; system of claim 8, wherein the cavity is filled with a pressurized non-conductive gas.

13. The multi-beam system of claim 12, wherein the pressurized non-conductive gas comprises a gas selected from a list consisting of: $N_2$, $SF_6$, dry air and combinations thereof.

14. The multi-beam system of claim 8, wherein each of the plurality of electron beam RF amplification devices comprises an inductive output tube that is part of a multi-beam inductive output tube system.

* * * * *